US007139495B2

(12) United States Patent
Morihara et al.

(10) Patent No.: US 7,139,495 B2
(45) Date of Patent: Nov. 21, 2006

(54) FIXING APPARATUS AND IMAGE FORMING APPARATUS

(75) Inventors: Kazushige Morihara, Yokohama (JP); Hiroshi Nakayama, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 123 days.

(21) Appl. No.: 10/743,492

(22) Filed: Dec. 23, 2003

(65) Prior Publication Data

US 2005/0135820 A1 Jun. 23, 2005

(51) Int. Cl.
*G03G 15/20* (2006.01)

(52) U.S. Cl. ..... 399/33; 399/69

(58) Field of Classification Search ..... 399/33, 399/67, 69, 70, 88
See application file for complete search history.

(56) References Cited

U.S. PATENT DOCUMENTS 6,246,843 B1 * 6/2001 Nanataki et al. ..... 219/216
6,615,003 B1 9/2003 Nakayama
6,724,999 B1 * 4/2004 Kikuchi et al. ..... 399/69
2003/0228178 A1 12/2003 Morihara

FOREIGN PATENT DOCUMENTS

JP 8-339134 A 12/1996
JP 9-197854 A 7/1997
JP 2002-236429 A 8/2002

* cited by examiner

*Primary Examiner*—David M. Gray
*Assistant Examiner*—Ryan Gleitz
(74) *Attorney, Agent, or Firm*—Foley & Lardner LLP

(57) ABSTRACT

If a temperature of a heat roller 12 rises abnormally, a thermostat 54 operates. When the thermostat 54 operates, a conduction path to an excitation coil 91 of a relay 90 is cut off so that a normally open contact 92 of the relay 90 can be operated. When the normally open contact 92 operates, the supply path of a drive signal supplied from a frequency variable oscillator 81 to a transistor 63 is cut off. By the cut-off, a high-frequency current does not flow through coils 14*a* to 14*c*; therefore, induction heating with respect to the heat roller 12 is stopped.

12 Claims, 4 Drawing Sheets

FIXING APPARATUS AND IMAGE FORMING APPARATUS

BACKGROUND OF THE INVENTION

1. Field of the Invention

The present invention relates to a fixing apparatus, which is built into an image forming apparatus such as copy machine and printer, and fixes a toner (developer) image on a paper sheet.

2. Description of the Related Art

Recently, induction heating has been practically used as heat source of a fixing apparatus used for an electrophotography system. According to induction heating, high-frequency current is carried to coils so that a high-frequency magnetic field can be generated by the coils. A heat roller generates an eddy current using the high-frequency magnetic field, and thereafter, self-heats using joule heat by the eddy current.

The fixing apparatus employing the foregoing induction heating has a thermostat as a thermally sensitive element for sensing the temperature of the heat roller. The thermostat operates to cut off the input current to the fixing apparatus if the temperature of the heat roller rises abnormally. Induction heating is stopped according to the cut-off, thereby preventing the temperature of the heat roller from rising abnormally.

However, in order to cut off the input current to the fixing apparatus, a thermostat having a large rated current (e.g., 10 A to 15 A) must be used. The large rated current thermostat has a large heat capacity, and is late to response speed. For this reason, a time lag is generated until the thermostat operates after the temperature of the heat roller rises abnormally. This is a factor of giving thermal influence to the heat roller and its peripheral sections.

On the other hand, JPN. PAT. APLLN. KOKAI Publication No. 9-197854 discloses the following technique. According to the technique, there is provided a thermistor, which senses the temperature of the heat roller, and a relay, which operates when the temperature sensed by the thermistor rises abnormally. The contact of the relay is inserted and connected to the conducting path to coils. More specifically, if the temperature of the heat roller rises abnormally, the relay operates to open its contacts, and thereby, conduction to the coils is cut off, so that induction heating can be stopped. However, in this case, a large current of about 60 A flows through the coils, and thus, a high voltage of about 900 V is applied to the coils. In order to cut off the foregoing large current and high voltage, a large type relay must be used. However, the large type relay for cutting off the large current and high voltage is expensive; therefore, it is not suitable for practical use.

JPN. PAT. APLLN. KOKAI Publication No. 2002-236429 discloses the following technique. According to the technique, there is provided a thermostat, which senses the temperature of the heat roller. The thermostat operates to cut off the supply of operating voltage to the drive means of a switching element if the temperature of the heat roller rises abnormally. The switching element is used for supplying a high-frequency current to coils. However, in this case, a special IC must be used as the drive means of the switching element. The special IC is expensive; therefore, it is not suitable for practical use.

JPN. PAT. APLLN. KOKAI Publication No. 8-339134 discloses the following technique. According to the technique, there is provided a thermistor, which senses the temperature of a fixing roller. In the thermistor, the resistance value varies greatly if the temperature of the fixing roller rises abnormally. When the resistance variation occurs, conduction to a fuser is cut off according to control using the IC. Induction heating is stopped by the cut-off of the conduction to prevent the temperature of the fixing roller from rising abnormally. However, control using the IC is made between temperature sensing by a thermistor and cut-off of conduction to the fuser. For this reason, if failure occurs in the control, the conduction to the fuser is not cut off. As a result, it is impossible to prevent the temperature of the fixing roller from rising abnormally.

In addition, JPN. PAT. APLLN. KOKAI Publication No. 8-339134 discloses the following structure. There is provided a relay, which operates when the temperature of the heat roller rises abnormally, and the contact of the relay is inserted and connected to the conducting path to coils. However, according to the structure, there is a problem that the large type relay for cutting off a large current and high voltage must be used like the foregoing Publication No. 8-339134.

BRIEF SUMMARY OF THE INVENTION

The present invention has been made in view of the circumstances described above. It is, therefore, an object of the present invention to provide a fixing apparatus and an image forming apparatus, which can quickly and securely prevent the temperature of a heat roller from rising abnormally without using a large type relay for cutting off a large current and high voltage and ICs for drive and control.

According to an aspect of the present invention, there is provided a fixing apparatus comprising:

a heat roller;

one or several induction heating coils arranged along an axial direction of the heat roller;

one or several resonance circuits composed of the coil;

one or several switching elements for exciting the resonance circuit;

one or several oscillators outputting on/off signals for driving on and off the switching element;

one or several thermostats opening and closing in accordance with a temperature of the coil; and one or several relays through which an operating current flows via the thermostat, the relay having a contact being inserted and connected to a conduction path of on/off signals supplied from the oscillator to the switching element.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

[1] The first embodiment of the present invention will be described below with reference to the accompanying drawings.

Figure 1:
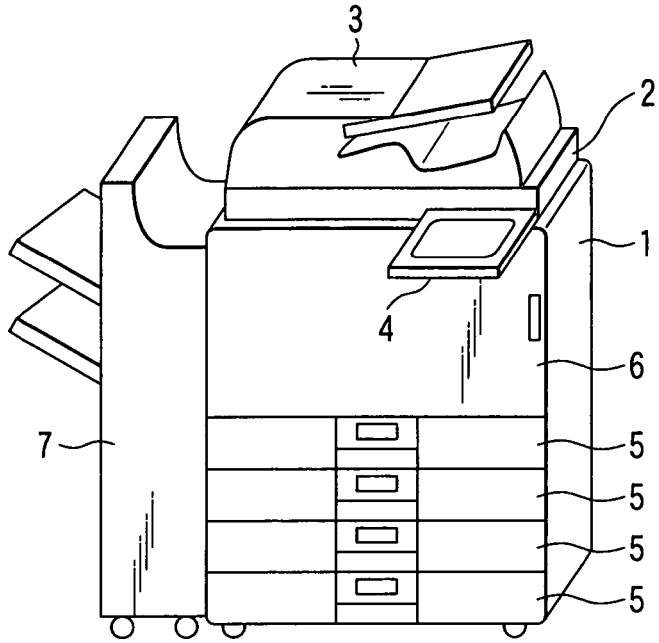
FIG. 1 is a view showing the appearance of an electronic copy machine according to each embodiment.

As shown in FIG. 1, an image forming apparatus, for example, an electronic copy machine main body 1 is provided with a document tray 2 at the upper portion. An automatic document feeder (ADF) 3 is provided on the document tray 2 so that it can be freely opened and closed. A control panel 4 used as operating means for setting operating conditions is attached at the same height position as the document tray 2.

The lower portion of the main body 1 is provided with several cassettes for receiving image forming media, that is, various size paper sheets. The front side of the main body 1 is provided with a front cover 6, which freely opens and closes. The front cover 6 is opened, and thereby, maintenance and inspection of the main body 1 is possible.

The side of the main body 1 is provided with a paper delivery (discharge) unit 7 for receiving printed paper sheets.

The configuration and operation of the electrophotography process are publicly known; therefore, detailed explanation is omitted.

A fixing apparatus 11 includes a heat roller 12, and a press roller 13, which rotates together with the heat roller 12 while contacting therewith in a pressed state. A paper sheet P is fed while being held between the foregoing two rollers.

Figure 2:
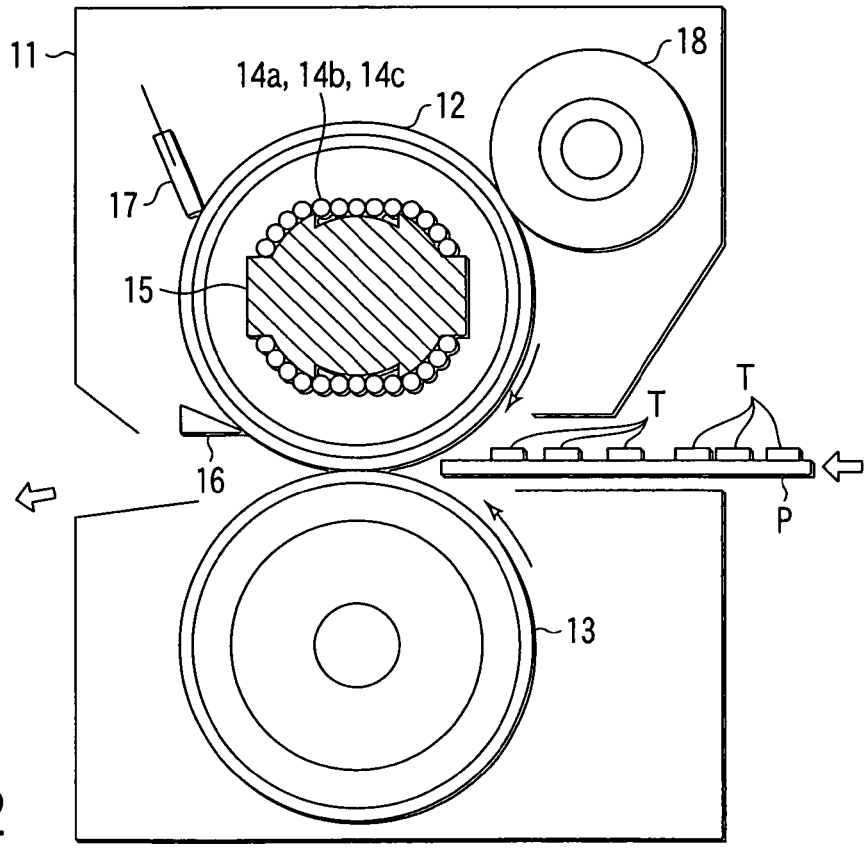
FIG. 2 is a view showing the structure according to each embodiment.

The heat roller 12 is formed in a manner of molding a conductive material, for example, iron into a cylinder, and coating Teflon on the outer peripheral surface of the iron. The heat roller 12 is rotated in the right-hand direction in FIG. 2. The press roller 13 rotates in the left-hand direction in FIG. 2 by receiving the rotation of the heat roller 12. The paper sheet P passes through a contact portion between the heat roller 12 and the press roller 13, and receives heat from the heat roller 12. A toner image on the paper sheet P is fixed on the paper sheet P.

First coil 14*a*, second coils 14*b* and 14*c* for induction heating are received in the internal space of the heat roller 12 in a state of closely contacting therewith. These coils 14*a* to 14*c* are wounded and held around a core 15, and generate a high-frequency magnetic field for induction heating. The high-frequency magnetic field is generated, and thereby, an eddy current is generated in the heat roller 12. The heat roller 12 self-heats using the joule heat by the eddy current.

The heat roller 12 is provided with a separator pawl 16, cleaning member 17 and applicator roller 18 around there. The separator pawl 16 is used for separating the paper sheet P from the heat roller 12. The cleaning member 17 is used for removing toner and wastepaper remaining on the heat roller 12. The applicator roller 18 is used for coating mold-releasing agent (mold lubricant) on the surface of the heat roller 12.

Figure 3:
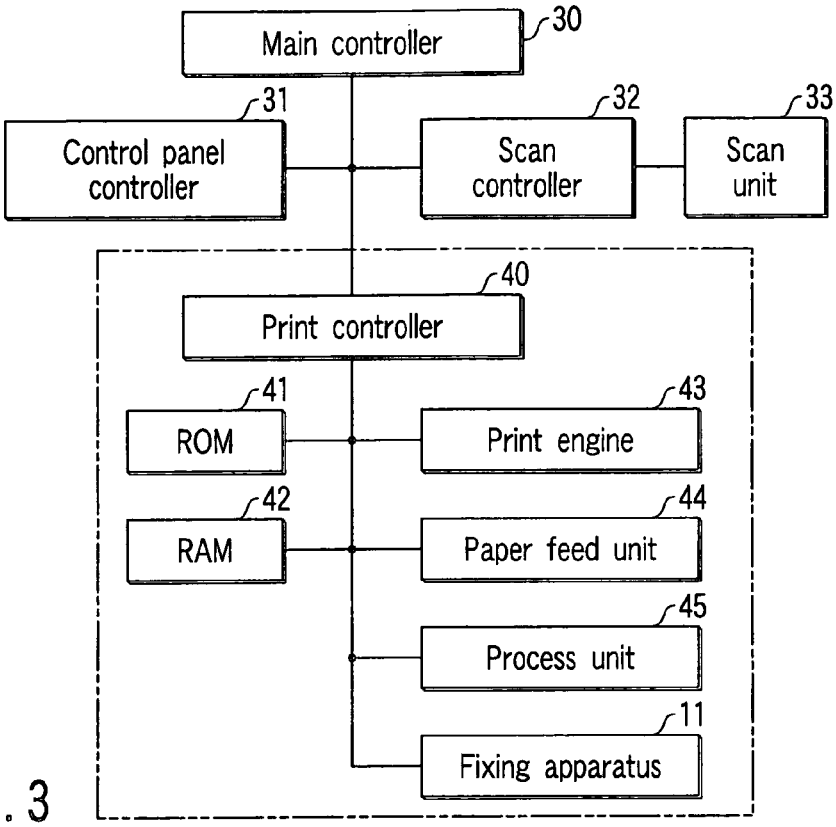
FIG. 3 is a block diagram showing a control circuit of the electronic copy machine according to each embodiment.

FIG. 3 shows the control circuit of the main body 1.

A main controller 30 is connected with control panel controller 31, scan controller 32 and print controller 40. The main controller 30 collectively controls these control panel controller 31, scan controller 32 and print controller 40.

The scan controller 32 is connected with a scan unit 33 for scanning the document. The print controller 40 is connected with ROM 41 for storing control programs, RAM 42 for storing data, print engine 43, paper sheet feed unit 44, process unit 45 and the fixing apparatus 11. The print engine 43 comprises a laser beam drive system. The paper sheet feed unit 44 is composed of paper sheet feed mechanism and drive circuit. The process unit 45 is composed of photosensitive drum and its peripheral parts.

Figure 4:
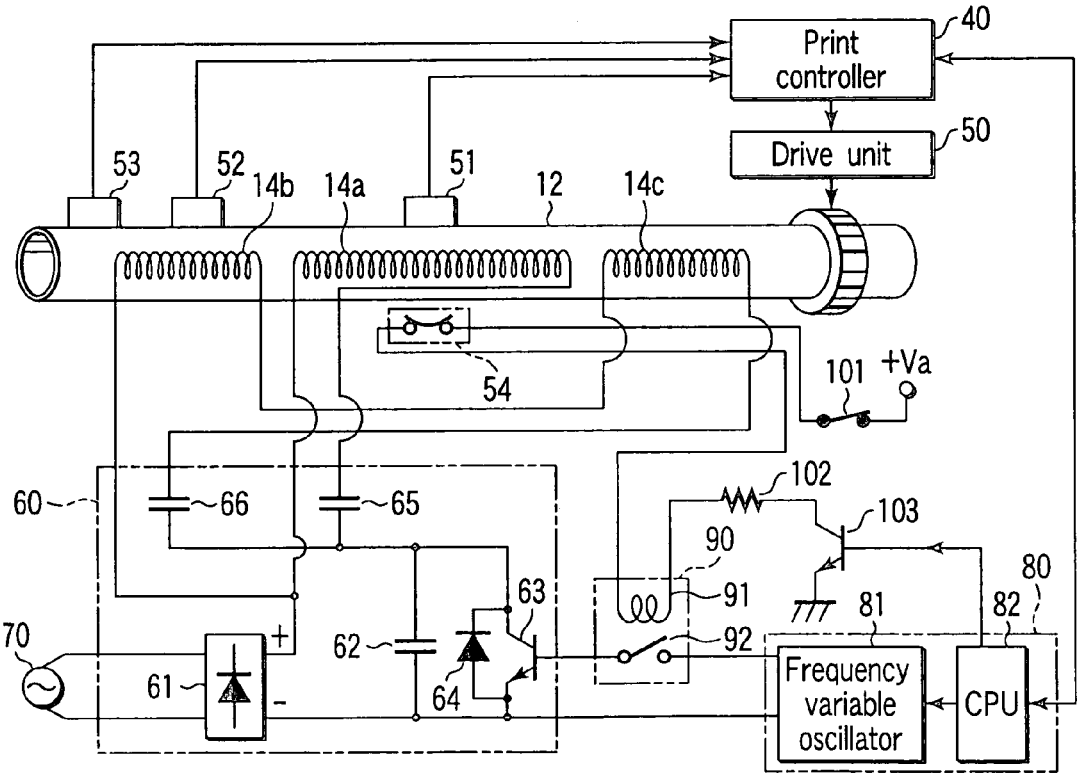
FIG. 4 is a block diagram showing an electric circuit according to a first embodiment.

FIG. 4 shows an electric circuit of the fixing apparatus 11.

One of coils 14*a* to 14*c* in the heat roller 12, that is, the coil 14*a* is arranged at the position corresponding to the approximately middle portion along the axial direction of the heat roller 12. Coils 14*b* and 14*c* are mutually connected in series to form one coil. The coil 14*b* is arranged at the position corresponding to one end portion (left end portion) along the axial direction of the heat roller 12. The coil 14*c* is arranged at the position corresponding to the other end portion (right end portion) along the axial direction of the heat roller 12.

If short size (A4R size) paper sheet P is fixed, the coil 14*a* is used. If normal size (A4 size) paper sheet P is fixed, coils 14*a* to 14*c* are all used. These coils 14*a* to 14*c* are connected to a high-frequency generator circuit 60.

The heat roller 12 is provided with a temperature sensor 51 at the approximately middle portion along the axial direction of the heat roller 12. The heat roller 12 is further provided with temperature sensors 52 and 53 at one end portion of the heat roller 12. These temperature sensors 51 to 53 are connected to the print controller 40 together with a drive unit 50 for rotating the heat roller 12.

The print controller 40 has the following function in addition to a function of controlling the drive unit 50. The function is to control each drive of a first resonance circuit comprising the coil 14*a* and a second resonance circuit comprising coils 14*b* and 14*c* in accordance with the size of the paper sheet P and detection temperature of temperature sensors 51 to 53. The first and second resonance circuits will be described later.

There is provided with a small heat capacity thermostat 54, which has rated voltage of 24 V and rated current of 1 A, at the approximately middle portion along the axial direction of the heat roller 12. The thermostat 54 has high responsibility because their heat capacity is small. Therefore, the thermostat 54 operates immediately when the temperature of the heat roller 12 rises abnormally. In the present invention, any other forms may be used so long as the thermostat has rated voltage of 30 V or less and rated current of 1 A or less.

The high frequency generator circuit 60 generates high frequency power for generating a high frequency magnetic field. The generator circuit 60 includes rectifier circuit 61, capacitor 62 for forming resonance circuit, capacitors 65 and 66 for controlling frequency, transistor (FET) 63 and damper diode 64. More specifically, the rectifier circuit 61 rectifies the alternating voltage of a commercial alternating power source 70. The capacitor 65 forms the first resonance circuit together with the capacitor 62 and the coil 14*a*. The capacitor 66 forms the first resonance circuit together with the capacitor 62 and the coils 14*b*; 14*c*. The transistor 63 is used as a first switching element for exciting the first and second resonance circuits. The damper diode 64 is connected between the collector-emitter of the transistor 63. The output terminal of the rectifier circuit 61 is connected with the first and second resonance circuits. The collector-emitter of the transistor 63 is connected in parallel with the capacitor 62.

A resonance frequency f1 of the first resonance circuit is determined by inductance L1 of the coil 14*a* and combined electrostatic capacitance of electrostatic capacitance C0 and C1 of capacitors 62 and 65. A resonance frequency f2 of the second resonance circuit is determined by inductance L2 of the coils 14*b*; 14*c* and combined electrostatic capacitance of electrostatic capacitance C0 and C2 of capacitors 62 and 66.

The collector-emitter of the transistor 63 of the high-frequency generator circuit 60 is connected to the output terminal of a variable frequency oscillator 81 of a controller 80 via a normally open contact 92 of a relay 90. The variable frequency oscillator 81 generates either of drive signals of frequencies f1 and f2 with respect to the transistor 63. In other words, the normally open contact 92 of a relay 90 opens and closes the supply path of the drive signal with respect to the transistor 63. Therefore, a small-size relay having small current is used as the foregoing relay 90.

Direct current voltage Vd (24 V) is applied to an excitation coil of the relay 90 via series-connected cover switch 101, thermostat 54, resistor 102 and the collector-emitter of second switching element, that is, transistor 103. The cover switch 101 links with the open and close operation of the front cover 6 of the main body 1. The cover switch 101 closes when the front cover is closed while opening when it is opened. The transistor 103 is connected to a CPU (control section) 82 of a controller 80.

The CPU 82 of the controller 80 controls the oscillation frequency of the variable frequency oscillator 81 and transistor 103 in accordance with instructions from the print controller 40. The CPU 82 has the following means (1) to (3) as the main function.

(1) The CPU 82 powers on the transistor 103 during the operation of the main body 1.

(2) When receiving instructions to fix the short size (A4R size) paper sheet P from the print controller 40, the CPU 82 carries out the following control with respect to the variable frequency oscillator 81. The variable frequency oscillator 81 outputs the drive signal of the frequency f1 so that induction heating by the coil 14*a* can be carried out. The CPU 82 makes the on-off control of the output operation so that the detection temperature of the temperature sensor 51 is set to a constant value.

(3) When receiving instructions to fix the normal size (A4 size) paper sheet P from the print controller 40, the CPU 82 carries out the following control with respect to the variable frequency oscillator 81. The variable frequency oscillator 81 alternately outputs the drive signals of the frequencies f1 and F2 so that induction heating by the coil 14*a* and the coils 14*b*; 14*c* can be alternately carried out. The CPU 82 makes the on-off control of the output operation so that each detection temperature of the temperature sensors 51 to 53 is set to a constant value.

The following is an explanation about the operation of the fixing apparatus 11.

When the operation of the main body 1 is stated, direct current voltage Vd is generated while the transistor 103 is powered on. When the transistor 103 is powered on, current based on the direct current voltage Vd flows through the excitation coil 91 of the relay 90 via cover switch 101, thermostat 54, resistor 102 and the collector-emitter of the transistor 103. Thus, a normally open contact 92 of the relay 90 closes.

When the normally open contact 92 of the relay 92 closes, the drive signal outputted from the variable frequency oscillator 81 is supplied to the transistor 63 so that the transistor 63 can be powered on and off. Power on/off of the transistor 63 excites the first and second resonance circuits, and thereby, a high-frequency magnetic field is generated from coils 14*a* to 14*c*. By the high-frequency magnetic field, induction heating is carried out with respect to the heat roller 12, and thereafter, preparation for fixing is completed.

If the temperature of the heat roller 12 rises abnormally due to any causes, the thermostat 54 operates. When the thermostat 54 operates, the conduction path to the excitation coil 91 of the relay 90 is cut off. By the cut-off, the normally open contact 92 opens so that no drive signal can be supplied to the transistor 63 from the variable frequency oscillator 81. Thus, the transistor 63 is not driven, and thereby, the first and second resonance circuits are not excited. As a result, the high-frequency magnetic field is not generated from coils 14*a* to 14*c*; therefore, induction heating with respect to the heat roller 12 is completed. When induction heating is completed, the heat roller 12 is soon released from abnormal temperature rise.

If the CPU 82 of the controller 80 detects the failure of the main body 1, the CPU 82 powers off the transistor 103, and thereby, the normally open contact 92 of the relay 90 opens to forcilly stop induction heating with respect to the heat roller 12. The following matters will be given as the failure of the main body 1.

(a) Detection temperature failure by the temperature sensors 51 to 53;

(b) Crash of the software of the print controller 40; and (c) Incapable of stopping the operation of the variable frequency oscillator 81.

In order to make maintenance and inspection of the main body 1, the front cover 6 of the main body 1 is opened. In this case, the cover switch 101 powers off. When the cover switch 101 powers off, the conduction path to the excitation coil 91 of the relay 90 is cut off. By the cut-off, induction heating with respect to the heat roller 12 is completed in the same manner as described above.

As is evident from the foregoing description, there is provided the relay 90 for opening and closing the supply path of the drive signal to the high frequency generator circuit 60. The thermostat 54 cuts off the conduction path to the excitation coil 91 of the relay 90. The structure described above serves to reduce the current flowing through the thermostat 54. Consequently, it is possible to employ the thermostat 54, which has small heat capacity and excellent responsibility, and to quickly and securely prevent the temperature of the heat roller 12 from rising abnormally.

In particular, the normally open contact 92 of the relay 90 opens and closes the drive signal to the transistor 63, so that a small-size relay having small current can be used as the relay 90. Therefore, the reduction of cost is achieved.

The normally open contact 92 of the relay 90 opens and closes the drive signal to the transistor 63, and in addition, there is no need of using drive IC like the conventional case. Therefore, the reduction of cost is achieved.

The normally open contact 92 of the relay 90 opens and closes the drive signal to the transistor 63, and thereby, the structure is simple. As a result, there is no need of using control IC like the conventional case. Therefore, the reduction of cost is achieved, and it is possible to quickly and securely prevent the temperature of the heat roller 12 from rising abnormally without causing control failure.

[2] The second embodiment will be explained below.

Figure 5:
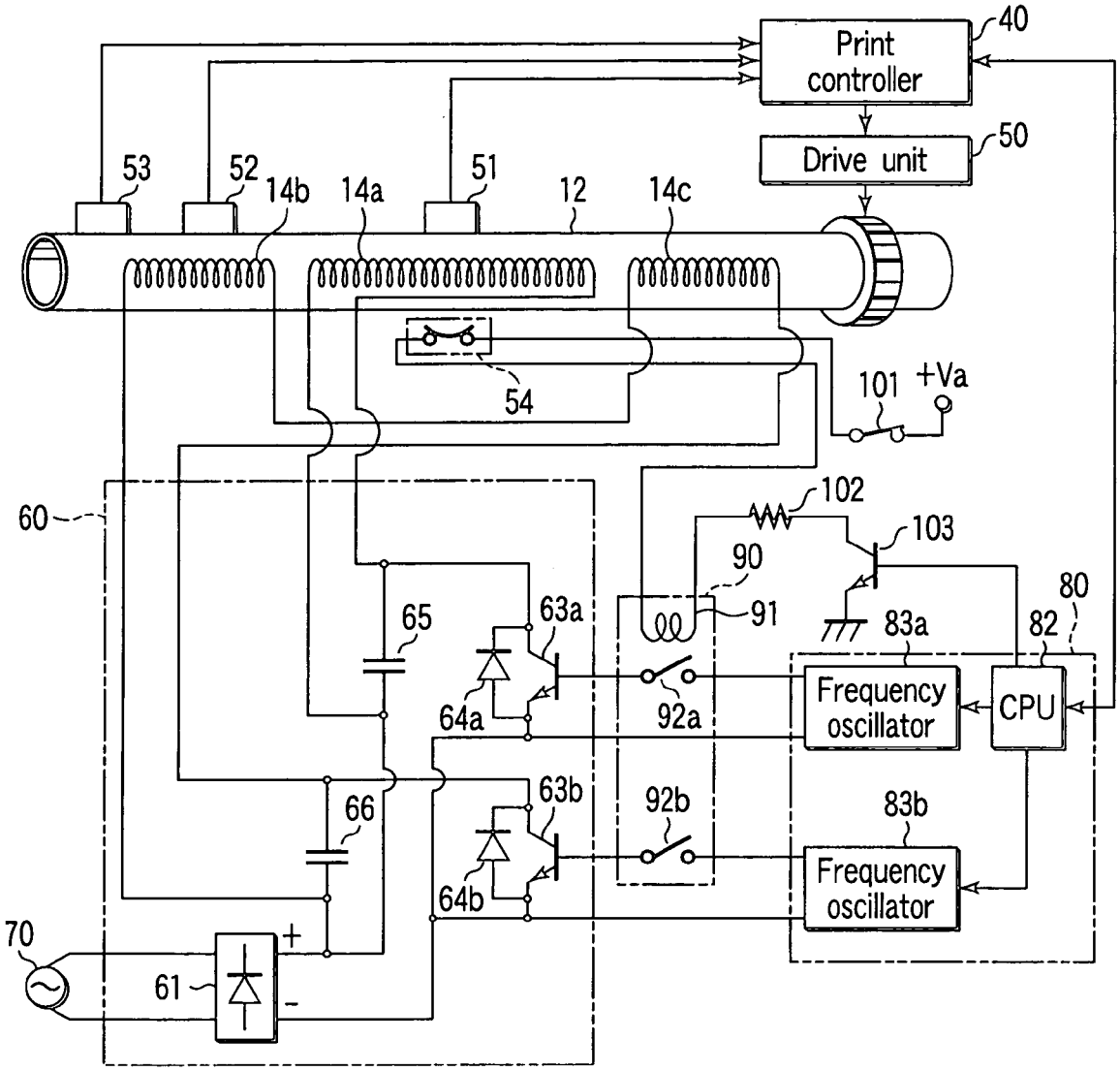
FIG. 5 is a block diagram showing an electric circuit according to a second embodiment.

FIG. 5 shows the configuration of an electric circuit of the fixing apparatus 11.

The high-frequency generator circuit 60 generates high-frequency power for generating a high-frequency magnetic field. The generator circuit 60 includes rectifier circuit 61, capacitors 65 and 66, transistors 63*a* and 63*b* (first switching elements), and damper diodes 64*a* and 64*b*. More specifically, the rectifier circuit 61 rectifies the alternating voltage of a commercial alternating power source 70. The capacitor 65 forms the first resonance circuit together with the coil 14*a*. The capacitor 66 forms the first resonance circuit together with the coils 14*b* and 14*c*. The transistor 63*a* is used for exciting the first resonance circuit; on the other hand, the transistor 63*b* is used for exciting the second resonance circuit. The damper diodes 64*a* and 64*b* are connected between the collector-emitter of individual transistors 63*a* and 63*b*. The output terminal of the rectifier circuit 61 is connected with the first and second resonance circuits.

A resonance frequency f1 of the first resonance circuit is determined by inductance L1 of the coil 14*a* and electrostatic capacitance of electrostatic capacitance C1 of the capacitor 65. A resonance frequency f2 of the second resonance circuit is determined by inductance L2 of the coils 14*b*; 14*c* and electrostatic capacitance of electrostatic capacitance C2 of the capacitor 66.

The collector-emitter of the transistor 63*a* of the high-frequency generator circuit 60 is connected to the output terminal of a frequency oscillator 83*a* of the controller 80 via the normally open contact 92*a* of the relay 90. The frequency oscillator 83*a* generates a drive signal of the frequency f1 with respect to the transistor 63*a*. The collector-emitter of the transistor 63*b* of the high-frequency generator circuit 60 is connected to the output terminal of a frequency oscillator 83*b* of the controller 80 via the normally open contact 92*b* of the relay 90. The frequency oscillator 83*b* generates a drive signal of the frequency f2 with respect to the transistor 63*b*.

The CPU 82 of the controller 80 controls the operation of the frequency oscillator 83*a*; 83*b* and the transistor 103 in accordance with instructions from the print controller 40. The CPU 82 has the following means (1) to (3) as the main function.

(1) The CPU 82 powers on the transistor 103 during the operation of the main body 1.

(2) When receiving instructions to fix the short size (A4R size) paper sheet P from the print controller 40, the CPU 82 carries out the following with respect to the frequency oscillator 83*a*. The frequency oscillator 83*a* is operated so that induction heating by the coil 14*a* can be carried out. The CPU 82 makes the on-off control of the output operation so that the detection temperature of the temperature sensor 51 is set to a constant value.

(3) When receiving instructions to fix the normal size (A4 size) paper sheet P from the print controller 40, the CPU 82 carries out the following control with respect to the frequency oscillators 83*a* and 83*b*. The frequency oscillators 83*a* and 83*b* are alternately operated so that induction heating by the coil 14*a* and the coils 14*b*; 14*c* can be alternately carried out. The CPU 82 makes the on-off control of the output operation so that each detection temperature of the temperature sensors 51 to 53 is set to a constant value.

Other circuit configuration is the same as the first embodiment.

The following is an explanation about the operation of the fixing apparatus 11.

When the operation of the main body 1 is stated, direct current voltage Vd is generated while the transistor 103 is powered on. When the transistor 103 is powered on, current flows through the excitation coil 91 of the relay 90 via cover switch 101, thermostat 54, resistor 102 and the collector-emitter of the transistor 103. Thus, normally open contacts 92*a* and 92*b* of the relay 90 close.

When the normally open contact 92*a* of the relay 92 closes, the drive signal output from the frequency oscillator 83*a* is supplied to the transistor 63*a* so that the transistor 63*a* can be powered on and off. Power on/off of the transistor 63*a* excites the first resonance circuit, and thereby, a high-frequency magnetic field is generated from the coil 14*a*. When the normally open contact 92*b* of the relay 92 closes, the drive signal output from the frequency oscillator 83*b* is supplied to the transistor 63*b* so that the transistor 63*b* can be powered on and off. Power on/off of the transistor 63*b* excites the second resonance circuit, and thereby, a high-frequency magnetic field is generated from the coils 14*b* and 14*c*. By the foregoing high-frequency magnetic field, induction heating is carried out with respect to the heat roller 12, and thereafter, preparation for fixing is completed.

If the temperature of the heat roller 12 abnormally rises due to any causes, the thermostat 54 operates. When the thermostat 54 operates, the conduction path to the excitation coil 91 of the relay 90 is cut off. By the cut-off, the normally open contacts 92*a* and 92*b* opens so that no drive signal can be supplied to the transistor 63*a* and 63*b* from the frequency oscillators 83*a* and 83*b*. Thus, the transistor 63*a* and 63*b* are not driven, and thereby, the first and second resonance circuits are not excited. As a result, the high-frequency magnetic field is not generated from coils 14*a* to 14*c*; therefore, induction heating with respect to the heat roller 12 is completed. When induction heating is completed, the heat roller 12 is soon released from abnormal temperature rise.

In order to make maintenance and inspection of the main body 1, the front cover 6 of the main body 1 is opened. In this case, the cover switch 101 powers off. When the cover switch 101 powers off, the conduction path to the excitation coil 91 of the relay 90 is cut off. By the cut-off, induction heating with respect to the heat roller 12 is completed in the same manner as described above.

The effect is the same as the first embodiment.

[3] The third embodiment of the present invention will be explained below with reference to the accompanying drawings.

Figure 6:
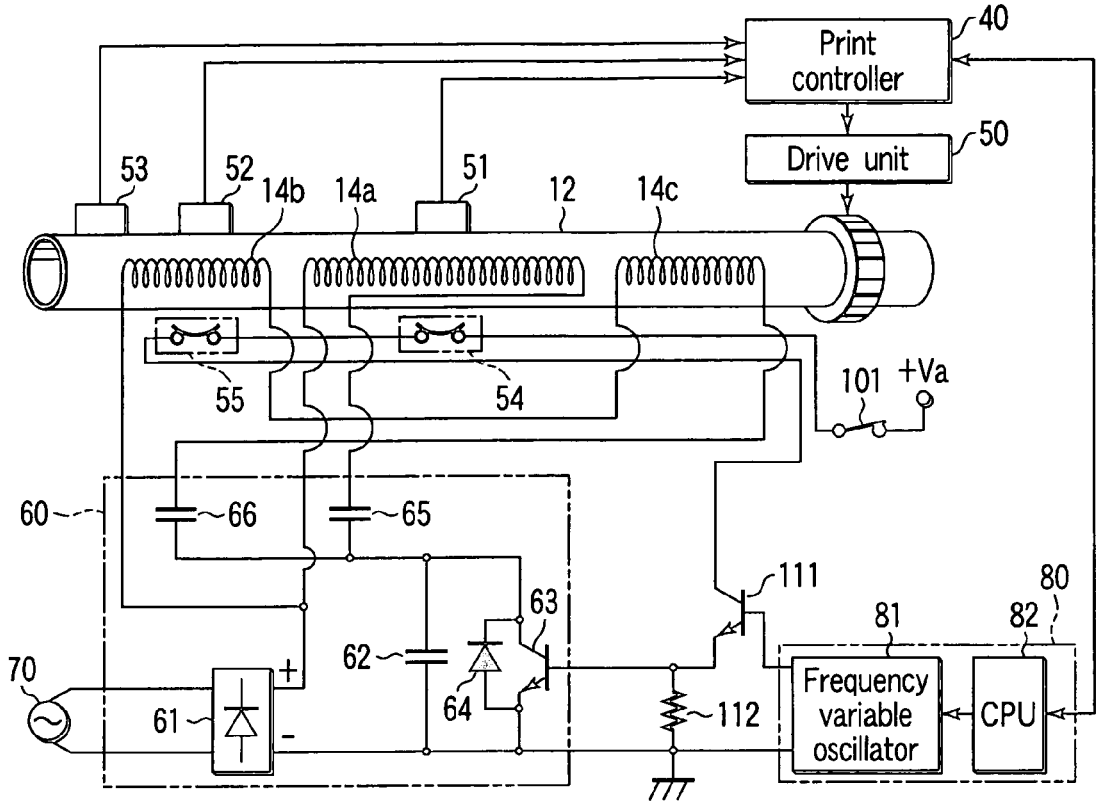
FIG. 6 is a block diagram showing an electric circuit according to a third embodiment.

FIG. 6 shows the configuration of an electric circuit of the fixing apparatus 11.

There is provided with small heat capacity first and second thermostats 54 and 55, which have rated voltage of 24 V and rated current of 1 A, at the approximately middle portion along the axial direction of the heat roller 12. The first and second thermostats 54 and 55 have has high responsibility because the heat capacity is small. Therefore, these thermostats 54 and 55 operate immediately when the temperature of the heat roller 12 abnormally rises.

Direct current voltage Vd (24 V) is applied to a resistor 112 via series-connected cover switch 101, thermostats 54, 55, resistor 102 and the collector-emitter of a transistor 111 (second switching element). The voltage generated in the resistor 112 is applied between the collector-emitter of the transistor 63 of the high-frequency generator circuit 60. The transistor 111 is connected to the variable frequency oscillator 81 of the controller 80. The variable frequency oscillator 81 generates either of drive signals of frequencies f1 and f2 with respect to the transistor 63.

In other words, the transistor 111 forms a drive conduction path to the transistor 63 together with cover switch 101, thermostats 54 and 55. The variable frequency oscillator 81 outputs on/off signals for powering on and off the transistor 63.

The CPU 82 of the controller 80 controls the oscillation frequency of the variable frequency oscillator 81 in accordance with instructions from the print controller 40. The CPU 82 has the following means (1) and (2) as the main function.

(1) When receiving instructions to fix the short size (A4R size) paper sheet P from the print controller 40, the CPU 82 carries out the following control with respect to the variable frequency oscillator 81. The variable frequency oscillator 81 outputs the drive signal of the frequency f1 so that induction heating by the coil 14*a* can be carried out. The CPU 82 controls on and off of the output operation so that the detection temperature of the temperature sensor 51 is set to a constant value.

(2) When receiving instructions to fix the normal size (A4 size) paper sheet P from the print controller 40, the CPU 82 carries out the following control with respect to the variable frequency oscillator 81. The variable frequency oscillator 81 alternately outputs the drive signals of the frequencies f1 and F2 so that induction heating by the coil 14*a* and coils 14*b*; 14*c* can be alternately carried out. The CPU 82 makes the on-off control of the output operation so that each detection temperature of the temperature sensors 51 to 53 is set to a constant value.

Other circuit configuration is the same as the first embodiment.

The following is an explanation about the operation of the fixing apparatus 11.

When the operation of the main body 1 is stated, direct current voltage Vd is generated while the variable frequency oscillator 81 alternately outputs the drive signals of the frequencies f1 and F2. According to the outputs, the transistor 111 powers on and off, and thereby, current continuously flows through the resistor 112. Based on voltage generated in the resistor 112 by the continuous current, the transistor 63 of the high-frequency generator circuit 60 powers on and off. Power on/off of the transistor 63 excites the first and second resonance circuits, and thereby, a high-frequency magnetic field is generated from coils 14*a* to 14*c*. By the high-frequency magnetic field, induction heating is carried out with respect to the heat roller 12, and thereafter, preparation for fixing is completed.

If the temperature of the heat roller 12 abnormally rises due to any causes, at least one of the thermostats 54 and 55 operates. When at least one of the thermostats 54 and 55 operates, the conduction path to the transistor 111 and the resistor 112 is cut off. By the cut-off, no drive signal is supplied to the transistor 63 even if the variable frequency oscillator 81 operates. Thus, the transistor 63 is not driven, and thereby, the first and second resonance circuits are not excited. As a result, the high-frequency magnetic field is not generated from coils 14*a* to 14*c*; therefore, induction heating with respect to the heat roller 12 is completed. When induction heating is completed, the heat roller 12 is soon released from abnormal temperature rise.

In order to make maintenance and inspection of the main body 1, the front cover 6 of the main body 1 is opened. In this case, the cover switch 101 powers off. When the cover switch 101 powers off, the conduction path to the transistor 111 and the resistor 112 is cut off. By the cut-off, induction heating with respect to the heat roller 12 is completed in the same manner as described above.

The effect is the same as the first embodiment.

[4] The fourth embodiment will be explained below.

Figure 7:
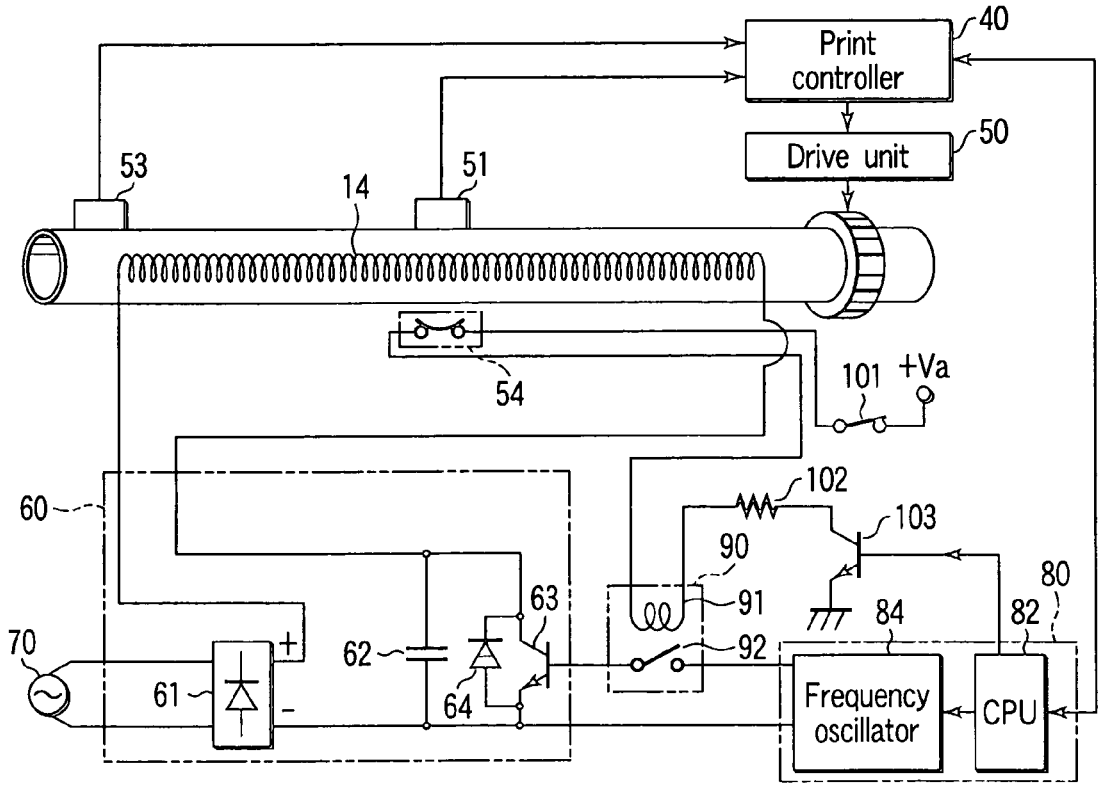
FIG. 7 is a block diagram showing an electric circuit according to a fourth embodiment.

As shown in FIG. 7, the heat roller 12 is provided with one coil 14. The coil 14 is connected to the high-frequency generator circuit 60.

The temperature sensor 51 is arranged at the approximately middle portion along the axial direction of the heat roller 12. The temperature sensor 53 is arranged at one end portion of the heat roller 12. The temperature sensors 51 and 53 are connected to the print controller 40 together with the drive unit 50 for driving the heat roller 12.

The print controller 40 has the following function in addition to a function of controlling the drive unit 50. The function is to control the drive of a resonance circuit (described later) comprising the coil 14 in accordance with detection temperature of temperature sensors 51 and 53.

The high-frequency generator circuit 60 generates high-frequency power for generating a high-frequency magnetic field. The generator circuit 60 includes rectifier circuit 61, capacitor 62, transistor (first switching element) 63, and damper diode 64. More specifically, the rectifier circuit 61 rectifies the alternating voltage of a commercial alternating power source 70. The capacitor 62 forms a resonance circuit together with the coil 14. The transistor 63 is used for exciting the resonance circuit. The damper diode 64 is connected between the collector-emitter of the transistor 63. The output terminal of the rectifier circuit 61 is connected with the resonance circuit.

A resonance frequency f of the resonance circuit is determined by inductance L1 of the coil 14 and electrostatic capacitance of electrostatic capacitance C0 of the capacitor 62.

The collector-emitter of the transistor 63 of the high-frequency generator circuit 60 is connected to the output terminal of a frequency oscillator 84 of the controller 80 via the normally open contact 92 of the relay 90. The frequency oscillator 84 outputs a drive signal of the frequency f1 with respect to the transistor 63.

The CPU 82 of the controller 80 controls the oscillation frequency of the frequency oscillator 84 and the transistor 103 in accordance with instructions from the print controller 40. The CPU 82 has the following means (1) to (2) as the main function.

(1) The CPU 81 powers on the transistor 103 during the operation of the main body 1.

(2) When receiving instructions to fix the paper sheet P from the print controller 40, the CPU 82 carries out the following control with respect to the frequency oscillator 84. The frequency oscillator 84 is operated so that induction heating by the coil 14 can be carried out. The CPU 82 makes the on-off control of the output operation so that the detection temperature of the temperature sensors 51 and 53 is set to a constant value.

Other circuit configuration is the same as the first embodiment.

The operation of the fixing apparatus 11 will be explained.

When the operation of the main body 1 is stated, direct current voltage Vd is generated while the drive signal of the frequency f1 is outputted from the frequency oscillator 84. According to the output, the transistor 63 of the high frequency generator circuit 60 powers on and off. The transistor 63 powers on and off, and thereby, the resonance circuit is excited so that a high frequency magnetic field can be generated from the coil 14. By the foregoing high-frequency magnetic field, induction heating is carried out with respect to the heat roller 12, and thereafter, preparation for fixing is completed.

If the temperature of the heat roller 12 abnormally rises due to any causes, the thermostat 54 operates. When the thermostat 54 operates, the conduction path to the excitation coil 91 of the relay 90 is cut off. By the cut-off, the normally open contact 92 opens so that no drive signal can be supplied to the transistor 63 from the frequency oscillator 84. Thus, the transistor 63 is not driven, and thereby, the resonance circuit is not excited. As a result, the high-frequency magnetic field is not generated from coil 14; therefore, induction heating with respect to the heat roller 12 is completed. When induction heating is completed, the heat roller 12 is soon released from abnormal temperature rise.

In order to make maintenance and inspection of the main body 1, the front cover 6 of the main body 1 is opened. In this case, the cover switch 101 powers off. When the cover switch 101 powers off, the conduction path to the excitation coil 91 of the relay 90 is cut off. By the cut-off, induction heating with respect to the heat roller 12 is completed in the same manner as described above.

The effect is the same as the first embodiment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a heat roller;

a coil arranged along an axial direction of the heat roller;

a resonance circuit composed of the coil;

a first switching element for exciting the resonance circuit;

a thermostat opening and closing in accordance with a temperature of the coil;

a second switching element forming a conduction path for driving the first switching element together with the thermostat; and an oscillator outputting on/off signals for driving on and off the second switching element.

2. The fixing apparatus according to claim 1, wherein the thermostat has rated voltage of 30 V or less and rated current of 1 A or less.

3. The fixing apparatus according to claim 1, wherein the thermostat has a small heat capacity, and opens and closes in accordance with a temperature of an approximately middle portion along the axial direction of the heat roller.

4. The fixing apparatus according to claim 1, wherein the thermostat includes:

a first thermostat, which has a small heat capacity, and opens and closes in accordance with a temperature of an approximately middle portion along the axial direction of the heat roller; and a second thermostat, which has a small heat capacity, and opens and closes in accordance with a temperature of one or the other end portion along the axial direction of the heat roller.

5. An image forming apparatus including the fixing apparatus described in claim 1, comprising:

a freely opening and closing cover provided on a main body of the image forming apparatus; and a switch opening and closing in accordance with opening and closing of the cover, and forming a conduction path for driving the first switching element together with the thermostat and the second switching element.

6. A fixing apparatus comprising:

a heat roller;

a resonance circuit which is configured with a coil and a capacitor;

a first switching element which is connected to the resonance circuit;

a thermostat which opens and closes in accordance with a temperature of the heat roller;

a second switching element which forms a conduction path to the first switching element with the thermostat; and an oscillator which outputs on/off signals to the first switching element through the second switching element.

7. The fixing apparatus according to claim 6, further comprising:

a CPU which controls the oscillator;

a temperature sensor which detects the temperature of the heat roller; and a controller which controls the CPU in accordance with an output of the temperature sensor.

8. The fixing apparatus according to claim 6, further comprising a second resonance circuit which is configured with a coil and a capacitor, and the second resonance circuit connects the resonance circuit in parallel.

9. The fixing apparatus according to claim 6, wherein the thermostat has rated voltage of 30 V or less and rated current of 1 A or less.

10. The fixing apparatus according to claim 6, wherein the thermostat opens and closes in accordance with a temperature of an approximately middle portion along an axial direction of the heat roller.

11. An image forming apparatus comprising:

a heat roller;

a resonance circuit which is configured with a coil and a capacitor;

a first switching element which is connected to the resonance circuit;

a thermostat which opens and closes in accordance with a temperature of the heat roller;

a second switching element which forms a conduction path to the first switching element with the thermostat; and an oscillator which outputs on/off signals to the first switching element through the second switching element.

12. The image forming apparatus according to claim 11, further comprising:

a freely opening and closing cover provided on a main body of the image forming apparatus; and a switch which opens and closes in accordance with opening and closing of the cover, and forms a conduction path to the first switching element together with the thermostat and the second switching element.

* * * * *